United States Patent [19]

Givler

[11] 4,374,372

[45] Feb. 15, 1983

[54] MODIFIED CONTACT STRIP MOUNTING MEANS FOR THERMOSTATIC SWITCHES

[75] Inventor: Omar R. Givler, North Canton, Ohio

[73] Assignee: Portage Electric Products, Inc., North Canton, Ohio

[21] Appl. No.: 269,312

[22] Filed: Jun. 1, 1981

[51] Int. Cl.[3] ..... H01H 37/04

[52] U.S. Cl. ..... 337/380; 337/112; 337/372

[58] Field of Search ..... 337/372, 380, 112, 381, 337/113, 20, 34, 121, 186, 327, 398, 414, 101

[56] References Cited

U.S. PATENT DOCUMENTS 3,223,809 12/1965 Wehl ..... 337/372

4,335,368 6/1982 Givler ..... 337/372

*Primary Examiner*—Harold Broome

*Attorney, Agent, or Firm*—McAulay, Fields, Fisher, Goldstein & Nissen

[57] ABSTRACT

An insulating cradle, in the form of an H, is provided for the mounting of the operative portions of a thermostatic switch. The H shaped configuration of the mounting member allows for operative portions both above and below an insulating center portion. The mounting means is so sized as to allow insertion into a metal case, with a friction fit, so as to assure proper mounting of all portions of the thermostatic switch.

8 Claims, 3 Drawing Figures

MODIFIED CONTACT STRIP MOUNTING MEANS FOR THERMOSTATIC SWITCHES

BACKGROUND OF THE INVENTION

A standard construction for thermostatic switches involves aligned contacts mounted on flexible strip members, at least one of the strips, or an adjacent piece, being formed of a usual bimetal for actuation of the device at a predetermined temperature. If one of the flexible arms is not formed of a bimetallic material, then a further bimetallic member must be formed which is in alignment with the flexible metal strips on which the aligned contacts are formed.

In many cases it is desirable to press fit this stack of operative members into a metallic casing. The metallic casing may form a contact for the device, or the device, even with the metal case, may be of the dead case type. Generally speaking, whether the case is a dead case or a live case is determined by the positioning of the flexible strip members in the stack and within the case.

One construction which allows the insertion of the operative members of the thermostatic switch stack into the metallic case is illustrated in U.S. Pat. No. 3,223,809, Wehl, assigned to the same assignee as the present invention. This patent describes and claims a U shaped, upwardly open block formed of an electrically insulating material, preferably porcelain. The operative portions of the thermostatic switch, including the flexible arms in which the contacts are mounted, the bimetallic member, and adjustment means, are mounted within, or adjacent to, this U shaped insulator.

A difficulty is encountered with this U shaped insulator, either with a dead or live case thermostatic switch, when operative members of the device must be placed adjacent both the top and the bottom of the case, but must be insulated from each other within the stack. For example, in copending application Ser. No. 234,242—Givler, now U.S. Pat. No. 4,335,368, issued June 15, 1982, assigned to the same assignee as the present invention, a dead case thermostat is described where the bimetallic member is placed on the bottom of the stack and is electrically insulated from the flexible arms. Because of this required construction, either the U shaped insulator of U.S. Pat. No. 3,223,809 cannot be adequately used, additional steps are required for assembly, or additional pieces are required for formation of an operative device.

BRIEF DESCRIPTION OF THE INVENTION

In accordance with the present invention an insulator, which allows for arrangement of the stacked, operative portions of a thermostatic switch, but provides for the separation of these portions, particularly when members at opposite ends of the stack must both be adjacent the case, is provided. This is accomplished by providing an H-shaped insulating member which allows for operative members of the stack to be placed both above and below a central insulating member formed as an integral member of the H-shaped insulating cradle. By forming the insulating member which holds the operative portions of the stack in the form of an H, a press fit into a metallic case is easily accomplished, and the operative members of the stack can be arranged so as to provide for the desired operation of the thermostatic switch.

After the operative members of the stack have been placed into the H-shaped insulating cradle member, and the entire assembly has been press fit into a metallic thermostatic switch casing, an epoxy or other resinous material can be placed over the open end of the casing so as to assure a permanent assembly.

DESCRIPTION OF THE PREFERRED EMBODIMENTS

Figure 2:
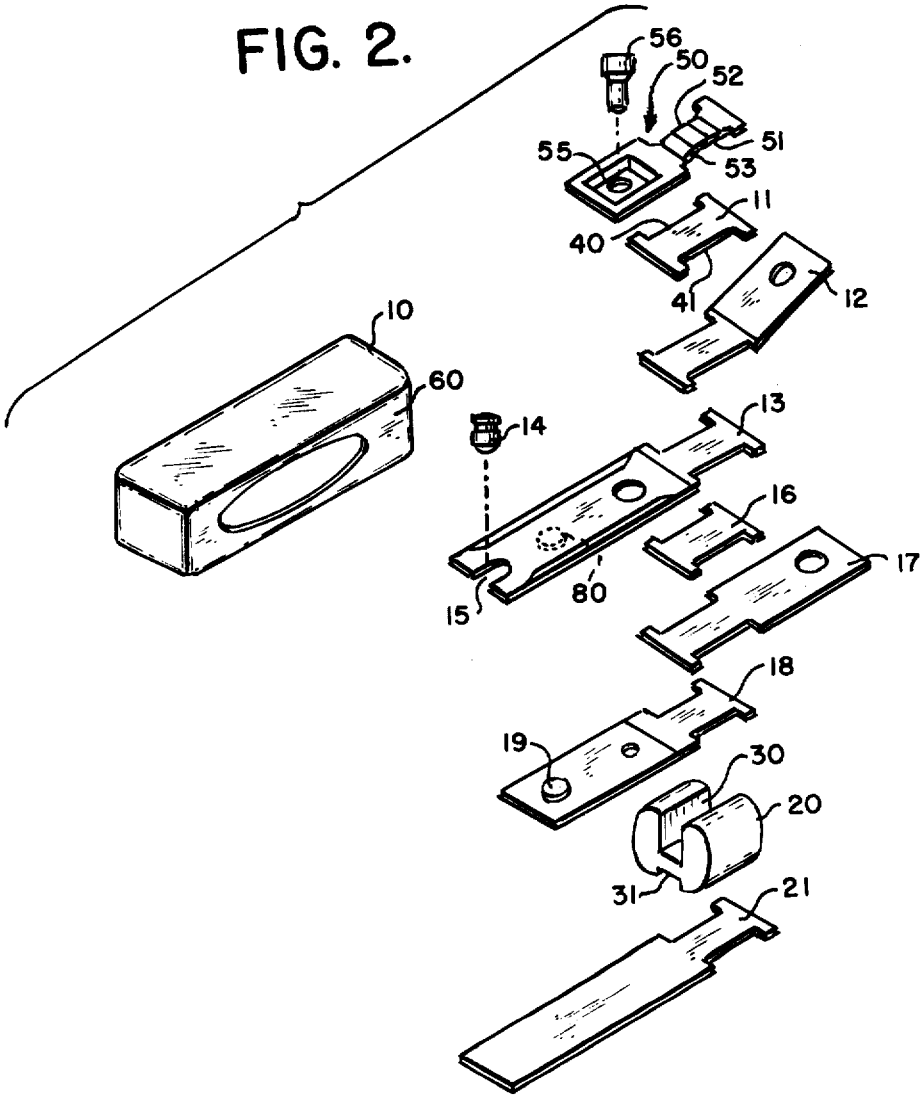
FIG. 2 is an assembly view, in perspective, showing the various parts of the thermostatic switch, including the H-shaped insulating cradle.

Referring to the accompanying drawings, and particularly to FIG. 2, the portions of a dead case thermostat are shown. They include a drawn steel case 10; an insulator-separator 11, formed of ceramic material; a quick connect 12, which provides one of the contacts at the outside of the thermostatic case; a stainless steel arm 13, having a contact 80, and with an insulator pin 14 formed for insertion into the opening 15 at one end of the stainless steel arm; another ceramic insulator-separator 16; a further quick connect 17, which forms the other contact on the outside of the case; a second stainless steel arm 18 having a contact member 19; and a bimetallic actuator arm 21. It will be seen that all of these operative members of the thermostatic switch are held within openings 30 and 31 of an H-shaped, insulating cradle 20. Each of the pieces described, from the first insulator-separator 11 through the bimetallic thermostat 21, is provided with a recess on either side, such as illustrated by the numbers 40 and 41 for the insulator-separator 11, so as to fit and lock within the openings 30 and 31 formed in the H-shaped porcelain block insulator cradle 20.

In addition to the members just recited, an additional piece, 50, may be added. This additional piece 50 will be referred to as a friction member and, while preferably made of stainless steel, can be made of any metal which is capable of being formed with an indented portion, such as illustrated at 51. As with the other members which go into forming the stack, the friction member 50 is provided with indented sections 52 and 53 which allow for it to be placed within the H shaped porcelain block insulator 20, particularly the opening 30 in that insulator, and held in place during insertion of the entire "stack" into the open end 60 of the case 10.

The specific form of the indentation on the friction member 50 is not critical. It can be, merely, a rounded bend in a narrowed portion of the friction member, as illustrated in FIG. 2, or can be a dimple formed in a similar portion of the friction member. Other forms of indentation will be apparent to those skilled in the art.

Figure 1:
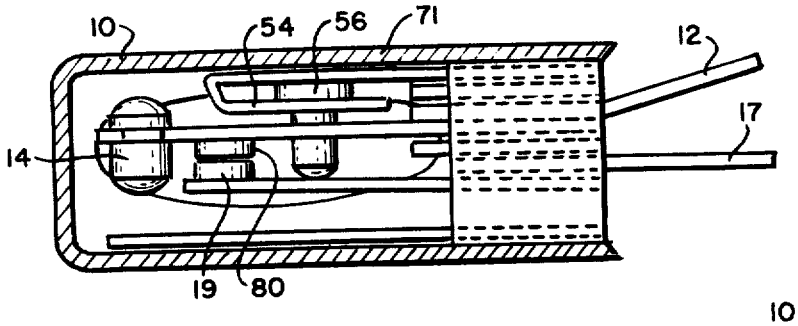
FIG. 1 is a sectional view of a fully assembled thermostatic switch, with the H-shaped insulating cradle holding the various stack members.
Figure 3:
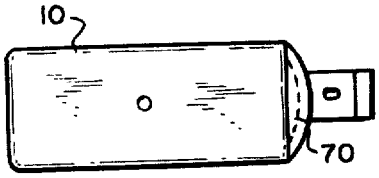
FIG. 3 is a plan view of an assembled thermostat, including an insulating resinous bonding material adjacent the opening of the thermostatic case.

As illustrated in FIGS. 1 and 2, the friction member 50 is formed with a lanced out section 54, the section 54 being provided with an opening 55. A calibration pin 56 is placed within the opening 55, prior to insertion of the stack into the case 10.

The opening 60 in the metal case 10 is sized so as to accommodate the width of the H shaped porcelain block insulator 20, and to just accept the height of the H shaped porcelain block insulator 20. The height of the H shaped porcelain block insulator is such as to accommodate each of the parts of the dead case thermostat such that, without the indentation 51, there is, essentially, a flush fit of the operating parts with the top and bottom of the H shaped porcelain block insulator 20. Thus, essentially, the bimetallic actuator arm 21 fully occupies the opening 31 provided at the bottom of the H shaped porcelain block insulator 20, while the stainless steel arm 50, in an unindented condition, the insulator-separator 11, the quick connect 12, the stainless steel arm 13, the insulator-separator 16, the quick connect 17, and the stainless steel arm 18 fit flush with the top of the H shaped porcelain block insulator 20 within the opening 30. The indentation 51 is so sized as to make the "stack" slightly larger than the height of the opening 60 in the case 10.

When the "stack," with the stainless steel arm 50 in place, is placed within the case, the indentation is sufficient to hold the parts in their assembled, and operating, condition within the case. If desired, an insulating resin, such as an epoxy 70, may be applied across the entire opening of the case to provide additional insulation and, in addition, to bond the operating members in place within the case.

In the embodiment illustrated in FIGS. 1 and 2, the calibration pin 56 is held upright within the opening 55 formed in the lanced section 54 of the stainless steel arm 50. The enlarged end of the calibration pin bears against the upper surface 71 of the case 10. The device can then be calibrated by crimping adjacent the calibration pin 56 on the upper surface 71. This crimping does not provide the danger of breakage of the ceramic insulators, as the pressure of the crimp is not applied against any of the ceramic parts of the device.

With the device assembled, and calibrated as illustrated, the thermostat can be attached in a line, as with any standard thermostat, employing the exposed contacts 12 and 17.

The invention has been described with regard to the H-shaped cradle insulator block 20 being employed in a dead case thermostat. This is one of the environments where the H-shaped member is particularly important. For example, in the construction illustrated, the bimetallic arm 21 lies directly against the bottom wall of the case to provide better thermal pick up. In some instances, it may be desired to weld the end of the number 21 to the bottom of the case. Particularly in that situation, the use of a U-shaped insulator block would not provide the desired benefit and, in fact, would require an extra assembly operation in order to lock the remainder of the stack into the proper position with the bimetal welded in place. In such a construction, the use of an H-shaped cradle, rather than a U-shaped cradle is essential for ease and economy of assembly.

While the invention has been described with regard to a dead-case thermostat, it will be apparent to those skilled in the art that even when the thermostatic switch is to be formed with a live case, constructions exist wherein some operative members of the stack should be placed below a central insulator member, and others above it. Frequently, an insulating member is not desired against the lower portion of the metallic case. Again, under those circumstances, the U-shaped member does not provide for adequate assembly of the stack members and insertion into the case. Members fitting below the insulating cross piece of the insulating block cannot be accurately and adequately held in place while the thermostatic switch is assembled. This can only be accomplished by use of the H-shaped cradle insulator block in accordance with the present invention.

The H-shaped cradle insulator block 20 of the present invention is shown with a relatively deep opening 30, and a relatively shallow opening 31. It should be apparent to those skilled in the art that the relative sizing of these openings is not critical to the present invention. The opening 30 can be shallower, and the opening 31 can be deeper, in accordance with the requirements of the particular thermostatic switch to be formed. In fact, if the given construction requires, the openings 30 and 31 can be of equal size. Further, with the H-shaped cradle insulator block of the present invention, the openings 30 and 31 need not be of the same width. If the construction of the thermostat is such that pieces on one side of the cross member are or should be narrower than those on the other side of this cross member, then, obviously, without requiring further machinery or additional parts to take up a slack, one of the openings 30 and 31 can be formed narrower than the other to accommodate these parts.

While specific embodiments of the invention have been shown and described, the invention should not be considered as so limited, but only as limited by the appended claims.

I claim:

1. In a thermostatic switch having operating members including a bimetallic member, at least one contact arm, connector members, and contacts adapted to establish or disconnect an electrical circuit, all of the operating members being held within a case having an open end, said open end having a first dimension and a second dimension, the improvement which comprises an H-shaped cradle insulator block having side pieces shaped and sized so as to occupy, in a press fit, said first dimension of the open end of said case within which the operative members are inserted, and a cross piece connecting said side pieces, said cross piece being so sized, in combination with the thickness of said cross pieces, as to provide a press fit in said second dimension of the open end of said case, said cross piece providing an upper opening and a lower opening in said H-shaped cradle insulator block.

2. The thermostatic switch of claim 1 wherein a bimetallic actuator is placed in the opening of said H-shaped insulator block below said cross piece, and two contact arms, each having an electrical contact member, are provided in the upper opening of said H-shaped cradle insulator block, above said cross piece.

3. The thermostatic switch of claim 1 wherein the opening in said H-shaped cradle insulator block above said cross piece is deeper than the opening below said cross piece.

4. The thermostatic switch of claim 1 wherein the depth of the openings above and below the cross piece of said H-shaped cradle insulator block are equal.

5. The thermostatic switch of claim 1 wherein the width of the openings above and below the cross piece of said H-shaped insulator block are equal.

6. The thermostatic switch of claim 1 wherein the metallic case into which the H-shaped cradle insulator member is placed is connected within the electrical circuit of said thermostatic switch.

7. The thermostatic switch of claim 1 wherein the electrical circuit is entirely through contact arms mounted in the H-shaped cradle insulator block, without current passing through said case.

8. The thermostatic switch of claim 7 wherein a bimetallic arm, which is not electrically connected to said contact arms, is placed in the lower opening of said H-shaped insulator block, and said bimetallic arm is welded to the adjacent portion of the case.

* * * * *